United States Patent [19]

Taylor, Jr. et al.

[11] Patent Number: 4,735,468

[45] Date of Patent: Apr. 5, 1988

[54] MOUNTING SOCKET

[75] Inventors: Benson T. Taylor, Jr., Floyd's Knobs, Ind.; John K. Besore, Louisville, Ky.

[73] Assignee: General Electric Company, Louisville, Ky.

[21] Appl. No.: 16,639

[22] Filed: Feb. 19, 1987

[51] Int. Cl.[4] ..... A47B 96/00

[52] U.S. Cl. ..... 312/214; 108/109; 211/134; 248/250; 248/558; 312/140; 312/351; 403/4

[58] Field of Search ..... 312/140, 214, 263, 351, 312/116; 403/3, 4, 192, 194; 248/250, 251, 558, DIG. 11, DIG. 12; 108/109, 110, 111; 211/134

[56] References Cited

U.S. PATENT DOCUMENTS

| | | | |
|---|---|---|---|
| 1,393,012 | 10/1921 | Dilg | 312/351 X |
| 2,604,375 | 7/1952 | Beckett . | |
| 2,620,254 | 12/1952 | Beckett . | |
| 2,620,255 | 12/1952 | Beckett . | |
| 2,657,894 | 11/1953 | Sklenar | 248/251 X |
| 2,872,270 | 2/1959 | D'Olive | 312/351 X |
| 2,973,998 | 3/1961 | Rackliffe | 312/351 X |
| 3,078,003 | 2/1963 | Kesling | 312/214 X |
| 3,149,811 | 9/1964 | Fremstad et al. | 248/251 |
| 3,331,646 | 7/1967 | Peters . | |
| 3,397,934 | 8/1968 | Dushek | 312/351 |
| 3,579,710 | 5/1971 | Gartzke . | |
| 3,631,821 | 1/1972 | Zachariou . | |
| 3,669,520 | 6/1972 | Jansen . | |
| 4,195,888 | 4/1980 | Squire . | |
| 4,627,760 | 12/1986 | Yagi et al. | 403/194 X |
| 4,653,714 | 3/1987 | Andrasko, Jr. | 248/251 |

FOREIGN PATENT DOCUMENTS

| | | | |
|---|---|---|---|
| 2654 | of 1881 | United Kingdom | 312/351 |
| 1240003 | 7/1971 | United Kingdom | 312/351 |

*Primary Examiner*—Peter A. Aschenbrenner
*Assistant Examiner*—Thomas A. Rendos
*Attorney, Agent, or Firm*—Frederick P. Weidner; Radford M. Reams

[57] ABSTRACT

A mounting socket installed in a compartment having spaced apart side walls with socket muonting holes and the side walls are spaced apart a greater distance at the front of the compartment relative to the back of the compartment. The socket is adapted to receive a horizontally extending support device and has a body with a first open end, a closed second end and an intermediate section therebetween. The body has an internal cavity extending along its central axis from the first end to the second end. The cavity has a horizontally oriented first portion adapted to receive a horizontally extending support device and has a first stop located in the intermediate section and a horizontally oriented second portion adapted to receive the horizontally extending support device and has a second stop located in the intermediate section with the second stop being spaced from the open end a distance less than the first stop. The first portion is the final resting position for the support device when the socket is mounted in the side wall at the back of the compartment and the second portion is the final resting place for the support device when the socket is mounted in the side wall at the front of the compartment.

9 Claims, 3 Drawing Sheets

MOUNTING SOCKET

BACKGROUND OF THE INVENTION

This invention relates to a mounting socket installed in a compartment such as a refrigerator and is adapted to permit simple installation and support of a horizontally extending support device such as a shelf support member within the compartment.

In certain compartments having shelf assemblies such as in household refrigerators there is a thin plastic liner forming the inside of the compartment which has been molded to the desired shape. In the plastic molding process in order to remove the formed liner from the mold it is necessary to have draft on each side which means that the side walls near the back of the liner forming the compartment are closer together than the side walls near the front of the compartment. After the formed compartment liner is incorporated in a refrigerator cabinet it is necessary to install horizontal support devices such as rectangular wire shelves which will support food items in the compartment. These wire shelves are rectangular in shape and desirably have the same width front and back and usually have the front support member and the rear support member extending outwardly of the shelf so that they may be supported on projections mounted on the side walls of the compartment. In some instances these support members are inserted into sockets which are installed through the compartment liner into the insulation between the liner and the outer case of the refrigerator. It is desirable that the horizontally extending support device cooperate with the mounting socket so that when the shelf is loaded with food items for storage there is sufficient support to prevent the horizontally extending support device from shifting laterally and becoming dislodged from the mounting socket causing the shelf to fall. This can be a problem where the sockets are mounted in the side walls at the front of the compartment which are spaced apart further than at the rear of the compartment and if the same dimension sockets are used for both locations.

Shelf mounting sockets particularly for refrigerator cabinets have been utilized in the past and one such example is shown in U.S. Pat. No. 2,620,255 wherein there is a shelf support socket provided that has a tubular body with a cavity terminating in an end wall which carries an inwardly extending compressible plug which is compressed by engagement with a shelf frame member but returns to its original length when the shelf is in its final position. One difficulty with this type of mounting socket is that frequent removable of the wire frame members into and out of the sockets has a tendency to reduce their effectiveness as the loss of resiliency deteriorates with age and the plug is distorted or destroyed after multiple insertions. It would, therefore, be advantageous to have a mounting socket that is rigid yet accomplishes the same function of centering the wire frame members to prevent one end from falling out of the socket.

Another example of a mounting socket is described in U.S. Pat. No. 4,195,888 wherein the mounting socket is inserted through the compartment liner into insulation of a refrigerator between the liner and the outer case. The mounting socket has only one final resting position for the mounting device which is not acceptable in the case of compartments wherein the side walls at the rear of the compartment are spaced apart a lesser distance than the side walls at the front of the compartment and the same mounting socket is used in both locations. It would be desirable to be able to have a rigid mounting socket that could be used at both the rear of the compartment and at the front of the compartment such that the draft formed in the compartment liner during the molding process is balanced out so that there is a minimal amount of lateral movement of the horizontally extending support device at the front of the compartment. That is, there should be a mounting system that is the same width front and back so that a rectangular wire shelf having equal length front and back support wires may be received in the compartment and have sufficient mounting socket support at the front as well as the rear of the compartment using the same interchangeable mounting sockets.

By this invention there is provided a mounting device that provides for the desirable advantages mentioned above.

SUMMARY OF THE INVENTION

A mounting socket installed in a compartment having spaced apart side walls with socket mounting holes and the side walls are spaced apart a greater distance at the front of the compartment relative to the back of the compartment. The sockets are adapted to receive a horizontally extending support device and has a body with an open first end, a closed second end and an intermediate section therebetween. The body has an internal cavity extending along its central axis from the first end to the second end. The cavity has a horizontally oriented first portion adapted to receive the horizontally extending support device and has a first stop located in the intermediate section and a horizontally oriented second portion adapted to receive the horizontally extending support device and has a second stop located in the intermediate section with the second stop being spaced from the open end a distance less than the first stop. The first portion is the final resting position for the support device when the socket is mounted in the side wall at the back of the compartment and the second portion is the final resting place for the support device when the socket is mounted in the side wall at the front of the compartment.

DESCRIPTION OF THE PREFERRED EMBODIMENT

The preferred mounting socket is of a type which is designed to be inserted in a hole in a refrigerator or freezer inner compartment and to extend into an insulation space between the liner forming the compartment and the outer shell of the cabinet. Normally pairs of sockets are mounted on opposite sides of the compartment of the refrigerator. A shelf of the type having a straight horizontally extending support member for insertion into the mounting socket is to be supported by the mounting sockets. The support members are spaced on the shelf to have an overall length greater than the distance between the inside walls of the inner liner or compartment to allow each member to be retained within an interior cavity of the sockets during normal use of the shelf.

Figure 1:
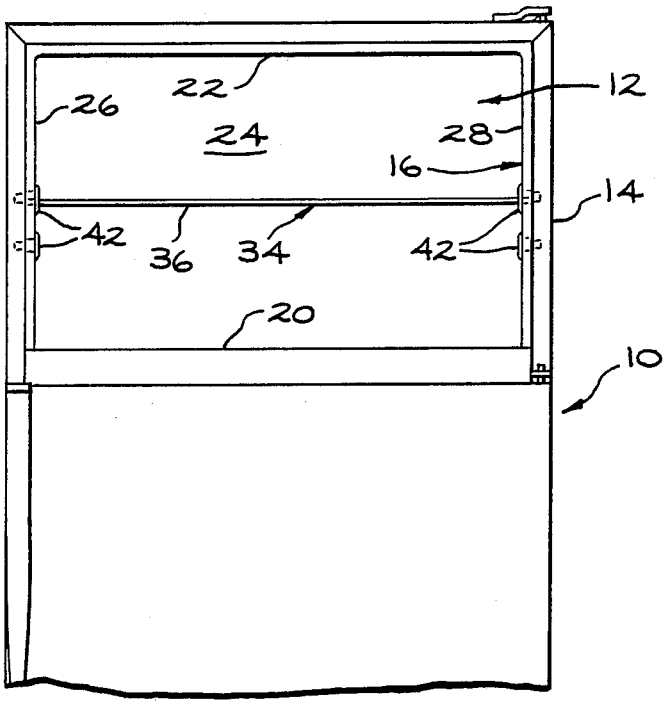
FIG. 1 is a front elevational partial view of a household refrigerator having a freezer compartment on top and incorporating the present invention.
Figure 2:
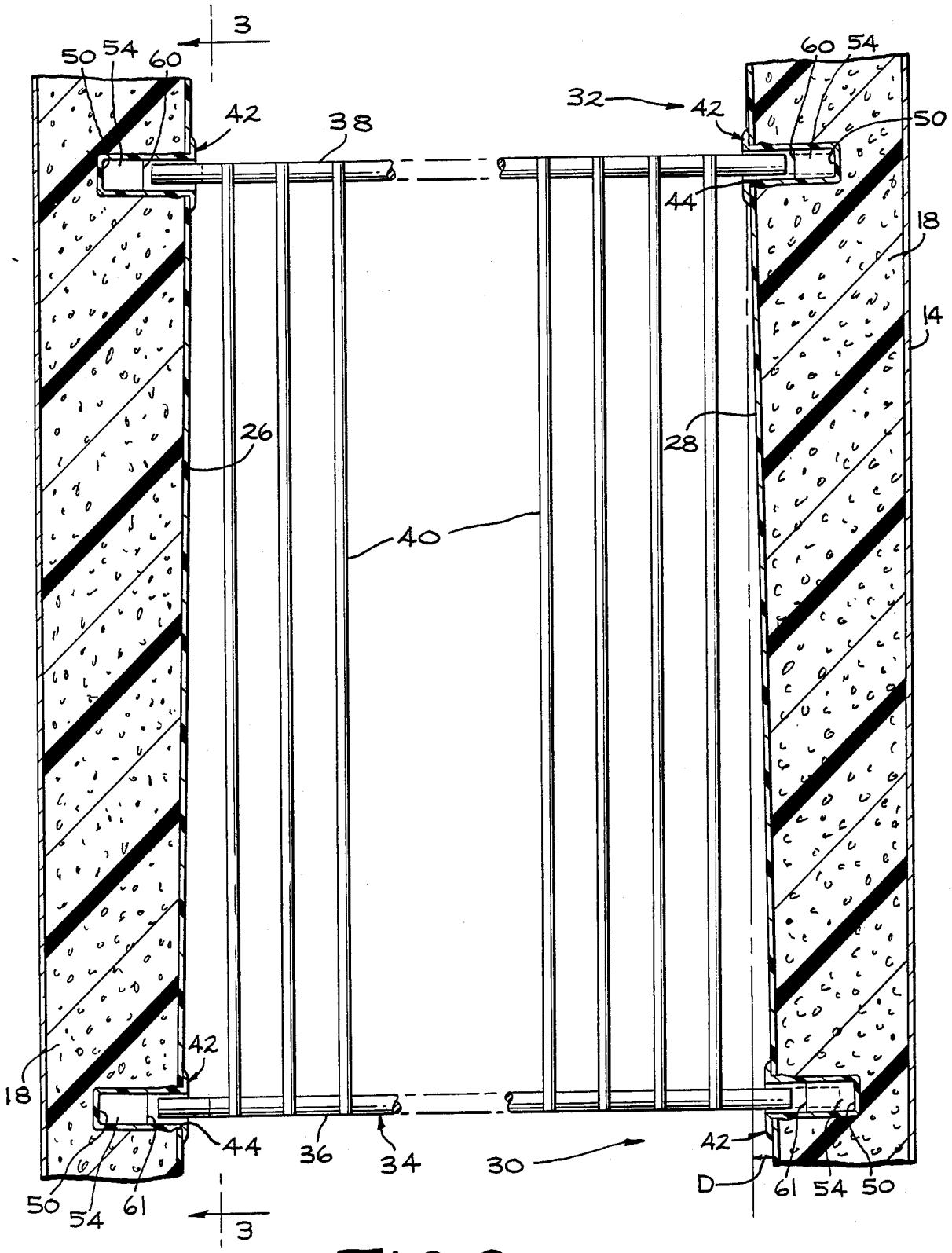
FIG. 2 is a top plan sectional view of a compartment such as a freezer compartment in a refrigerator showing a compartment with the present invention.

Referring to FIGS. 1 and 2, 10 indicates a household refrigerator having a freezer compartment 12 located at the top thereof with the access door removed. The refrigerator may be constructed with an outer shell 14 and an inner liner forming a compartment 16 spaced from each other to provide a space for insulation 18. The compartment 12 includes a bottom wall 20, a top wall 22, a back wall 24 and two side walls 26 and 28. As seen in FIG. 2 the side walls 26 and 28 have a draft designated "D" wherein the front section 30 of the compartment 12 has the side walls 26 and 28 a further distance apart than at the rear section 32 of the compartment which as indicated previously is due to the plastic molding operation of the compartment liner, such as a vacuum forming operation, wherein draft must be provided for the molded part to be removed from the mold. The side walls 26 and 28 of the compartment 16 support a horizontally extending support device 34 such as a wire grid shelf shown in FIG. 2. The horizontal extending support device 34 as shown includes a relatively heavy wire front frame member 36, a relatively heavy rear wire frame member 38, and a multiplicity of lighter transverse wire frame members 40. The transverse wire frame members 40 are spaced from each other, but may be arranged as close as desired so that there is no possibility of any food items falling through the shelf and yet allow the air to flow in and around the food items stored on the shelves. The transverse wires 40 are welded to the front and rear frame members 36 and 38.

The length of the transverse frame members 40 depends upon the depth of the compartment 16 from the front to the back; and these front to back frame members 40 are preferably such that the front frame member 36 is located adjacent to, but spaced from, the door opening. The length of the front frame member 36 and rear frame member 38 is greater than the space between the side walls 26 and 28 of the compartment so that frame members 36 and 38 may extend through shelf supporting mounting sockets 42 in the side walls and thereby have substantial engagement with the mounting sockets 42 into which the front and rear frame members 36 and 38 of the shelf are inserted for support.

The mounting sockets 42 are preferably identical in construction and therefore interchangeable so they can be used at the back or front of the compartment. They are closed sockets so that there are no open holes leading to the insulation from the inside of the compartment. The mounting sockets 42 are all mounted in apertures 44 in the side walls 26 and 28 of the compartment. The mounting sockets 42 as shown in FIG. 2 extend into the foam insulation 18 in the space between the side walls and the outer shell 14.

Figure 6:
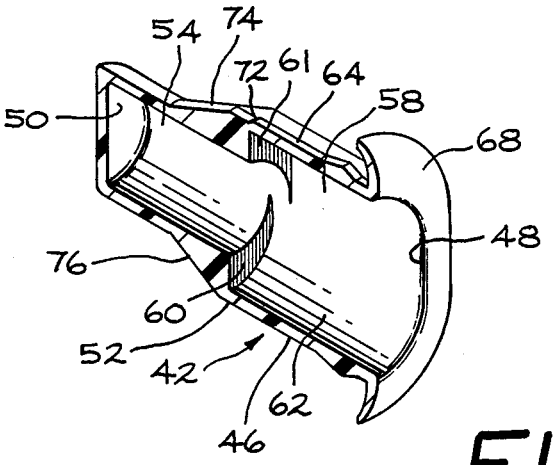
FIG. 6 is a cross-sectional perspective view of the present invention.
Figure 4:
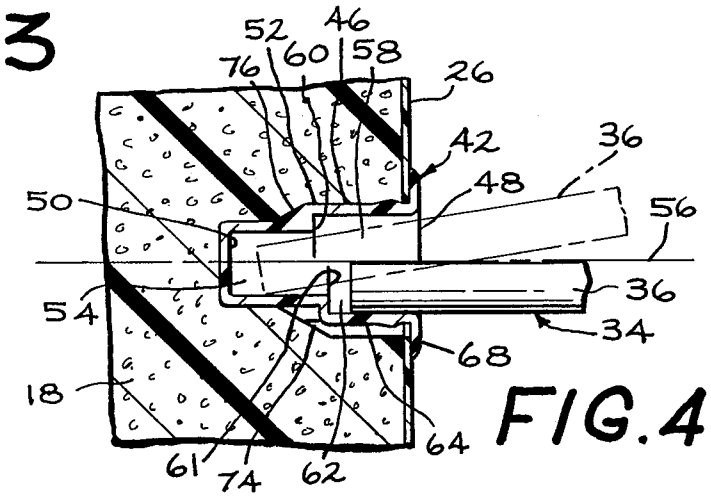
FIG. 4 is a view taken along lines 4—4 of FIG. 3 showing the present invention.
Figure 5:
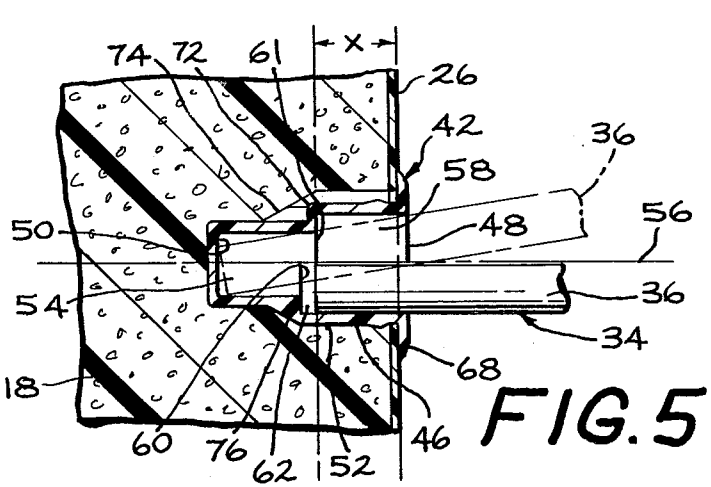
FIG. 5 is a view taken along lines 5—5 of FIG. 3 showing the present invention.

With reference particularly to FIGS. 4–6, the mounting socket 42 which is desirably formed from suitable plastic material has a body 46 with an open first end 48, a closed second end 50 and an intermediate section 52 therebetween. The body 46 has an internal cavity 54 extending along its central axis 56 from the first end 48 to the second end 50. The cavity 54 has a horizontally oriented first portion 58 which extends above the central axis 56 from the open first end 48 to a first stop 60 which is in the form of a molded-in shoulder located at the top of the mounting socket as shown in FIG. 4. The mounting socket cavity also has a horizontally oriented second portion 62 located at the bottom of the mounting socket as shown in FIG. 4 and extends below the central axis 56 from the open first end 48 to a second stop means 61 which is spaced from the open end 48 a distance less than the first stop 60. As can be seen in FIGS. 4 and 5, the first portion 58 is the final resting position for the support device 34 when the mounting socket is mounted in the side wall at the back of the compartment as shown in FIG. 5. The second portion 62 is the final resting place for the support device 34 when the mounting socket is mounted in the side wall at the front of the compartment as shown in FIG. 4.

Figure 3:
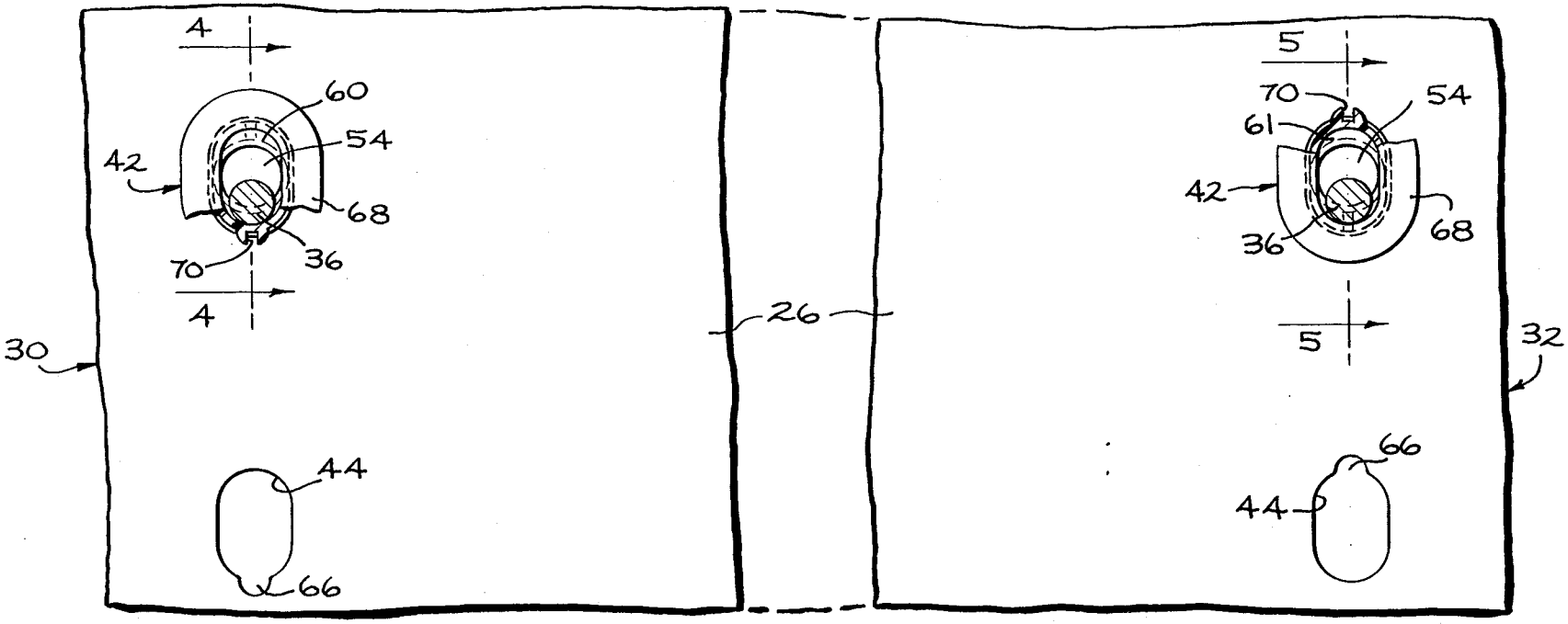
FIG. 3 is a side elevational view taken along lines 3—3 of FIG. 2 showing the present invention.

One of the desirable features of the present invention is to be able to have a single mounting socket structure that may be interchangeably used at the front of the compartment or at the back of the compartment and yet compensate for the difference in distance between the side walls due to the draft from the back of the compartment to the front of the compartment required in molding the compartment and have a rectangular shaped horizontally extending support device 34 having the front frame member 36 and the rear frame member 38 of equal length. This prevents unwieldy orientation of the horizontally extending support device if it had been constructed such that the front frame member 36 had a greater length than the rear frame member 38. By this invention the same mounting socket may be used but by rotating it 180 degrees between the front of the refrigerator and the rear of the refrigerator, it compensates for the difference in the distance between the side walls caused by the draft of the molding operation to form the compartment. To properly orient the mounting socket in either the front of the compartment 30 or the rear of the compartment 32 there is locating means 64 molded into one side of the mounting socket and as shown in FIGS. 4 and 5 in the preferred embodiment the locating means 64 is molded adjacent the horizontally oriented second portion 62. In the case of the preferred embodiment the locating means is in the form of a rib extending longitudinally along the outside of the body 46. To orient the mounting socket correctly in the aperture 44, the aperture is provided with a notch 66 which is slightly larger than the locating means 64 so that the mounting socket can be inserted into the aperture only if the locating means 64 is properly oriented relative to the notch 66. With reference to FIG. 3, the front of the compartment 30 is shown wherein the notch 66 is at the bottom of the aperture 44 and by inserting the mounting socket into the aperture 44 it takes the position as shown in FIG. 4. The rear of the compartment 32 is shown in FIG. 3 and in that case the notch 66 of aperture 44 is located at the top of the aperture. After the mounting socket has been inserted into the aperture the position of the socket is shown in FIG. 5. The mounting socket may be provided with a radially extending lip 68 which extends from the open first end 48 outwardly and is dimensioned to be larger than the aperture 44 so that upon insertion of the mounting socket in the aperture 44 it will extend inwardly into the insulation until the radially extending lip 68 abuts the area of the compartment surrounding the aperture 44. This lip not only helps orient the mounting socket in its proper position but will also prevent foam material from escaping around the mounting socket during the foaming operation of the insulation between the compartment and the outer shell 14. As shown in FIG. 3, the locating means 64 or rib has a longitudinal channel 70 which prevents sink marks in the radially extending lip 68 that would otherwise form in the process of molding the mounting socket 42 from plastic material. With reference to FIG. 5, it will be noted that the locating means 64 extends from the lip 68 rearward to a point designated 72 which is in a lateral plane that passes through the mounting socket 42 essentially at second stop 61. The distance from the lip 68 to the point 72 is designated "X" in FIG. 5. In the preferred embodiment this distance "X" was designed to help prevent a person from installing the mounting socket in the aperture incorrectly oriented. If there is such an attempt, the mounting socket can only be inserted to a position where it would fall out when released by the person installing it. The distance "X" may vary from one mounting socket design to another as long as the fall out function is accomplished.

The mounting socket 42 is also provided with a sloped section 74 (FIG. 6) immediately behind the locating means 64 and also a sloped section 76 on the opposite side of the mounting socket body. These sloped sections help make the insertion of the mounting sockets 42 into the apertures 44 and prevent jamming the body portion forming the stops 60 and 61.

With the mounting sockets 42 installed in their proper positions as described above and shown in the drawing, the horizontally extending support device and in particular the ends of the front frame member 36 and the rear frame member 38 are inserted into the cavity 54 and along the central axis 56 at one side of the compartment as shown in phantom line in FIGS. 4 and 5 and then the opposite end of the horizontally extending support device 34 is lowered at the other side of the compartment so that the ends of the front frame member 36 and rear frame member 38 may be inserted into the two mounting sockets located in the opposite side wall. The horizontally extending support device 34 is then moved slightly so that the ends of the front frame member 36 and rear frame member 38 find their respective final resting place in the horizontally oriented first portion 58 and the horizontally oriented second portion 62 as shown in full line in FIGS. 4 and 5. In the case of the preferred embodiment and as shown in FIGS. 3–5, at the front section 30 of the compartment 16 the front frame member 36 rests in the second portion 62 of the cavity 54 while at the rear section 32 of the compartment 16 the rear frame member 38 rests in the first portion 58 of the cavity 54. It will be noted particularly in FIG. 6 that the first portion 58 and second portion 62 which have first stop 60 and second stop 61 respectively may be semi-circular in shape to readily accept and properly seat the round frame members 36 and 38. When the horizontally extending support device 34 is properly positioned therein the first stop and second stop prevent sufficient sideways movement of the support device to dislodge it from the mounting sockets and cause it to fall.

The foregoing is a description of the preferred embodiment of the invention and it should be understood that variations may be made thereto without departing from the true spirit of the invention as defined in the appended claims.

What is claimed is:

1. A cabinet construction comprising:

a compartment having spaced apart side walls with socket mounting holes, said side walls being spaced apart a greater distance at the front of the compartment relative to the back of the compartment;

a horizontally extending support device in the compartment;

a mounting socket located in the mounting holes including a body having an open first end, a closed second end and an intermediate section therebetween, said body having an internal cavity extending along its central axis from said first end to said second end, said cavity having a horizontally oriented first portion being capable of receiving said horizontally extending support device and having a first stop located in the intermediate section and a horizontally oriented second portion directly opposite the first portion and being capable of receiving said horizontally extending support device and having a second stop directly opposite the side of the cavity having the first stop and located in the intermediate section, said second stop being spaced from the open end a distance less than the first stop, and said first portion being the final resting position for said support device when the socket is mounted in the side wall at the back of the compartment and said second portion being the final resting place for said support device when the socket is rotated 180° relative to the mounting position of the sockets at the back of the compartment and mounted in the side wall at the front of the compartment.

2. The cabinet construction of claim 1 wherein the mounting socket includes a radially extending lip from said first end of said body and overlying said wall around said socket mounting hole to maintain said first end adjacent said wall.

3. The cabinet construction as set forth in claim 1 wherein the socket mounting holes are notched and the mounting socket includes locating means radially extending from one side of the socket body to cooperate with the notched holes in the side walls to orient the mounting socket to its correct position either in the side wall at the rear of the compartment or in the side wall at the front of the compartment.

4. The cabinet construction of claim 1 wherein the body of the mounting socket is made of plastic material.

5. A refrigerator cabinet construction comprising:

an inner liner including a thin wall forming a compartment having spaced apart side walls with socket mounting holes, said side walls being spaced apart a greater distance at the front of the compartment relative to the back of the compartment;

an outer cabinet with an insulation space between it and that inner liner;

a horizontally extending support device in the compartment for supporting an internal shelf;

a mounting socket including a body having an open first end, a closed second end and an intermediate section therebetween, said body having an internal cavity extending along its central axis from said first end to said second end, said body being positioned within a socket mounting hole in a vertical area of said inner liner with said second end located within the insulation space, said cavity having a horizontally oriented first portion being capable of receiving said horizontally extending support device and having a first stop located in the intermediate section and a horizontally oriented second portion directly opposite the first portion and being capable of receiving said horizontally extending support device and having a second stop directly opposite the side of the cavity having the first stop and located in the intermediate section, said second stop being spaced from the open end a distance less than the first stop, and said first portion being the final resting position for said support device when the socket is mounted in the side wall at the back of the compartment and said second portion being the final resting place for said support device when the socket is rotated 180° relative to the mounting position of the sockets at the back of the compartment and mounted in the side wall at the front of the compartment.

6. The cabinet construction of claim 5 wherein the mounting socket includes a radially extending lip form said first end of said body and overlying said wall around said socket mounting hole to maintain said first end adjacent said wall.

7. The cabinet construction of claim 6 wherein the lip of the mounting socket extends about the entire circumference of said first end for sealing engagement with said wall.

8. The cabinet construction as set forth in claim 5 wherein the mounting socket includes locating means radially extending from one side of the socket body and the socket mounting holes have a notch so that the locating means and notch cooperate to orient the mounting socket to its correct position either in the side wall at the rear of the compartment or in the side wall at the front of the compartment.

9. The cabinet construction of claim 5 wherein the body of the mounting socket is made of plastic material.

* * * * *